US007744389B1

(12) United States Patent
Morris et al.

(10) Patent No.: US 7,744,389 B1
(45) Date of Patent: Jun. 29, 2010

(54) COMMUNICATION WITH A MULTI-CONTACT PAD HAVING A USB APPLICATION

(75) Inventors: Julie Anne Morris, Raleigh, NC (US); Michael Thano Matthews, Cary, NC (US); Jennifer Greenwood Zawacki, Hillsborough, NC (US)

(73) Assignee: Lenovo Singapore Pte. Ltd., Singapore (SG)

( * ) Notice: Subject to any disclaimer, the term of this patent is extended or adjusted under 35 U.S.C. 154(b) by 0 days.

(21) Appl. No.: 12/535,241

(22) Filed: Aug. 4, 2009

(51) Int. Cl.
*H01R 13/66* (2006.01)

(52) U.S. Cl. ..... 439/151; 439/170

(58) Field of Classification Search ..... 439/151, 439/170

See application file for complete search history.

(56) References Cited

U.S. PATENT DOCUMENTS 3,873,885 A * 3/1975 Elfverson ..... 315/312
3,875,479 A * 4/1975 Jaggar ..... 361/792
6,913,477 B2 * 7/2005 Dayan et al. ..... 439/188
7,172,196 B2 2/2007 Randall ..... 273/237
2007/0194526 A1 8/2007 Randall ..... 273/237
2009/0072782 A1 3/2009 Randall ..... 320/107
2009/0098750 A1 4/2009 Randall ..... 439/77

* cited by examiner

*Primary Examiner*—Javaid Nasri
(74) *Attorney, Agent, or Firm*—David Aker; Carlos Munoz-Bustamante

(57) ABSTRACT

Apparatus for making an electrical connection in a system requiring four electrical connections, including an electrical connection pad having an array of four types of electrically conductive contacts, all conductive contacts of a given type being electrically connected to all other conductive contacts of the same type; and an arrangement for providing electrical connections to conductive contacts on the pads, the arrangement having electrically conductive pins for making contact with the conductive contacts, wherein the types of electrically conductive contacts include two contacts for power and two separate contacts for signals. The pins may be arranged at corners of a first square and a second square, with the first square being rotated by forty-five degrees with respect to the second square, and a pin located at a common center of both squares. A method of operation of the apparatus, and various applications and configurations for its use.

15 Claims, 6 Drawing Sheets

COMMUNICATION WITH A MULTI-CONTACT PAD HAVING A USB APPLICATION

BACKGROUND OF THE INVENTION

1. Field of the Invention

The present invention relates to apparatus and methods, used for communication between devices via a contact pad. More particularly, it relates to those apparatus and methods for transferring power and signals between devices using a contact pad and has an application to Universal Serial Bus (USB) connections.

2. Background Art

Many devices communicate with a USB connection. Generally, to operate properly, a cable must be plugged into each device via a USB-A, USB-B, Mini-A, or Mini-B plug. Power, ground, and data are then transferred between the two devices, which may be, by way of example, and not by way of limitation, a personal computer and a Personal Digital Assistant (PDA) that must be periodically connected to the computer to transfer data or other files.

Although work is being done on Wireless USB, it is not integrated into many devices. Reliability and range issues associated with this technology are still being resolved.

Another alternative is to find a cable that matches the ports on each device (A, B, mini-A, mini-B) and then physically plug in the cable into the appropriate socket on each device. This may require that a variety of cables be purchased and be readily available, may be inconvenient in terms of having to plug various cables into a socket in a location that is difficult to reach, and may cause a great deal of "cable clutter" in what could otherwise be a neat and attractive office configuration. A better approach is required.

SUMMARY

One non-limiting embodiment of the invention is directed to an arrangement for making electrical connections, comprising electrically conductive contacts arranged at corners of a first square and corners of a second square, the first square being rotated by substantially forty five degrees with respect to the second square, the squares having a common center, and an electrically conductive contact disposed at the common center. The electrically conductive contacts can be electrically conductive pins.

In another non-limiting embodiment of the invention the arrangement can be used in combination with an electrical connection pad having an array of four types of electrically conductive contacts, all conductive contacts of a given type being electrically connected to all other conductive contacts of the same type; the electrically conductive contacts of the pad being sized, shaped and positioned to make electrical contact with selected one of the electrically conductive contacts of the arrangement.

By way of example, and not by way of limitation, the arrangement can be disposed on an outside surface of a portable electronic device so that the conductive pins contact the conductive contacts of the electrical connection pad to establish electrical connections to the portable device when the portion of the outside surface of the portable electronic device is placed on the pad.

The arrangement may further comprise circuitry configured to operate with the electrical connection pad so that the electrical connection pad has characteristics of a universal serial bus hub.

The electrical connection pad can include at least one universal serial bus connection port to which a universal serial bus device is connected for electrical connections to be made with the universal serial bus device.

The arrangement can be configured to be disposed on an underside surface of a portable computer, and used to provide temporary electrical connections to the portable computer. In another non-limiting embodiment, a second arrangement for a second portable device, the electrical connection pad facilitating electrical connections between the portable computer and the second arrangement.

The electrical connection pad can further comprise at least one universal serial bus cable port for connection to a universal serial bus port of a computer.

The types of electrically conductive contacts can comprise two contacts for power and two separate contacts for signals. The various embodiments can comprise circuitry for determining which of the electrical contacts of the arrangement is in contact with conductive contacts for electrical power, and which of the electrical contacts of the arrangement is in contact with conductive contacts for signal.

By way of example, and not by way of limitation, the arrangement can be configured to provide electrical connections for apparatus utilizing a standard selected from the group consisting of four pin IEEE 1394, telephone, USB, and Ethernet® RJ45 signal connections.

In a further embodiment, an apparatus comprises an electrical connection pad having an array of four types of electrically conductive contacts, all conductive contacts of a given type being electrically connected to all other conductive contacts of the same type; and circuitry for connecting the four types of electrical contacts to an electrical device for communication with the electrical device.

Yet another aspect is an apparatus comprising an electrical connection pad having an array of four types of electrically conductive contacts, all conductive contacts of a given type being electrically connected to all other conductive contacts of the same type; and circuitry for connecting the four types of electrical contacts to an electrical device for communication with the electrical device.

Embodiments are also directed to a machine-implemented method comprising providing an arrangement having electrically conductive pins for making contact with conductive contacts, wherein the pins comprise two pins for power and two separate pins for signals; and determining which of the pins is connected to power and which of the pins is connected to a signal.

The method can further comprise positioning the arrangement on an outside surface of a portable electronic device. The electronic device can be positioned so that the conductive pins contact the conductive contacts of an electrical connection pad to establish electrical connections to the portable electronic device when the portion of the outside surface of the portable electronic device is placed on the pad. The electrical connection pad can be configured to have an array of four types of electrically conductive contacts, wherein all conductive contacts of a given type are electrically connected to all other conductive contacts of the same type.

The method may be used to provide electrical connections for apparatus utilizing a standard selected from the group consisting of four pin IEEE 1394, telephone, USB, and Ethernet® RJ45 signal connections.

BRIEF DESCRIPTION OF THE DRAWINGS

The foregoing aspects and other features are explained in the following description, taken in connection with the accompanying drawings, wherein.

DETAILED DESCRIPTION OF THE PREFERRED EMBODIMENTS

Figure 1:
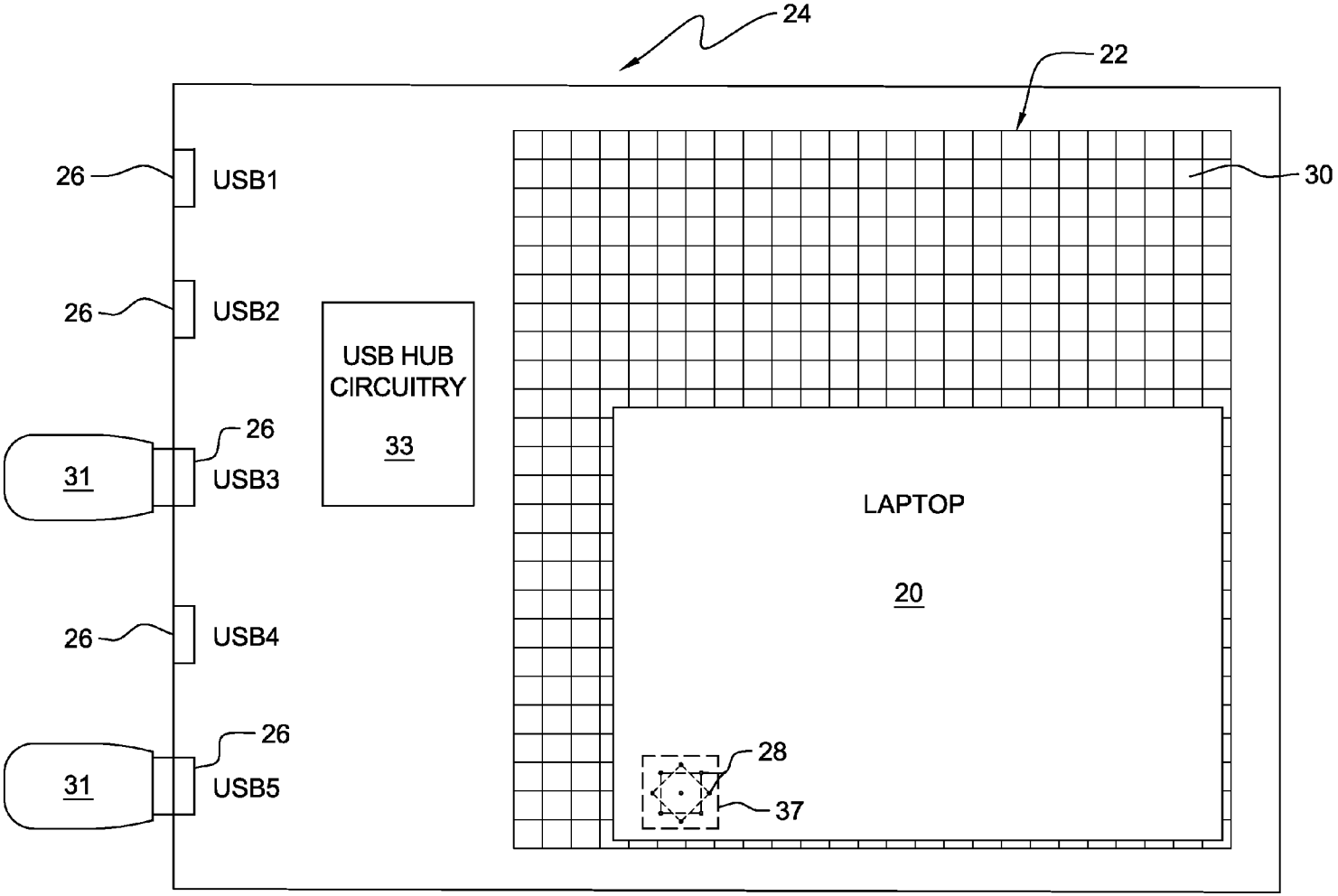
FIG. 1 is a first embodiment of a computer system using the apparatus and methods herein described.

Referring to FIG. 1, there is shown a plan view of a computer system incorporating features of a first embodiment. Although the present invention will be described with reference to non-limiting embodiments shown in the drawings, it should be understood that the present invention can be embodied in many alternate forms of embodiments. In addition, any suitable size, shape or type of elements or materials could be used. In addition, although the preferred embodiment herein is directed to a USB application, the present invention has applicability to a wide variety of technologies, including making electrical connection using many other industry standards such as, for example, and not by way of limitation, four pin IEEE 1394, telephone (only using data, replacing power), Ethernet® (using only data to an RJ45 connector), and any other four pin technologies that may be developed in the future.

In FIG. 1, a laptop computer 20 to which one or more USB devices are to be connected, has been placed atop a contact pad 22 of a USB connection apparatus 24. Apparatus 24 has a number of USB connection ports 26 into which USB devices which are to be connected to computer 20 may be plugged, either directly or via a cable, as is know in the art. However, advantageously, USB devices, such as flash memories 31, which are to be connected to computer 20 are, are plugged directly into ports 26. Apparatus 24 may be configured in part to have the characteristics of a USB hub, to which computer 20 is connected by being placed upon contact pad 22, due to the presence of connection pins 28 in its bottom, which make contact with individual electrically conductive contacts 30 on contact pad 22, as more fully described below. USB hub circuitry block 33 is disposed within USB connection apparatus 24.

A connection module 37, which may be located internally within computer 20, provides a structure for supporting pins 28, and may contain circuitry including a dedicated processor and software, or specific hardware that facilitates making proper electrical connections between computer 20 and conductive contacts 30 of contact pad 22, as more fully described below. In smaller and less expensive digital devices, where it may not be desirable to include a connection module 37 internally, a "clip-on" version can be used, wherein the connection module can be configured to plug into a port, such as a USB port, and can extend to the underside of the digital device, where the pins are supported for making proper electrical connections between the pins and the conductive contacts of a contact pad.

Computer 20 may be, for example, one of the ThinkCentre® or ThinkPad® series of personal computers sold by Lenovo (US) Inc. of Purchase, N.Y. As is well know in the art, computer 20 includes at least one system processor, which is coupled to a Read-Only Memory (ROM) and to a system memory by a processor bus. The system processor may comprise one of the PowerPC™ line of processors produced by IBM Corporation, and is a general-purpose processor that executes boot code stored within ROM at power-on and thereafter processes data under the control of an operating system and application software stored in system memory. The system processor is coupled via a processor bus and host bridge to a Peripheral Component Interconnect local bus. The PCI local bus supports the attachment of a number of devices, including adapters and bridges. Among these devices is a network adapter, which interfaces computer 20 to a LAN, and a graphics adapter, which interfaces computer 20 to its display. Communication on the PCI local bus is governed by a local PCI controller, which is in turn coupled to non-volatile random access memory (NVRAM) via a memory bus. The local PCI controller can be coupled to additional buses and devices via a second host bridge.

Computer 20 may further include an Industry Standard Architecture (ISA) bus, which is coupled to the PCI local bus by an ISA bridge. Coupled to the ISA bus. is an input/output (I/O) controller, which controls communication between computer 20 and attached peripheral devices such as an external keyboard, a mouse, and a disk drive. In addition, the I/O controller supports external communication by computer 20 via serial and parallel ports.

Figure 2:
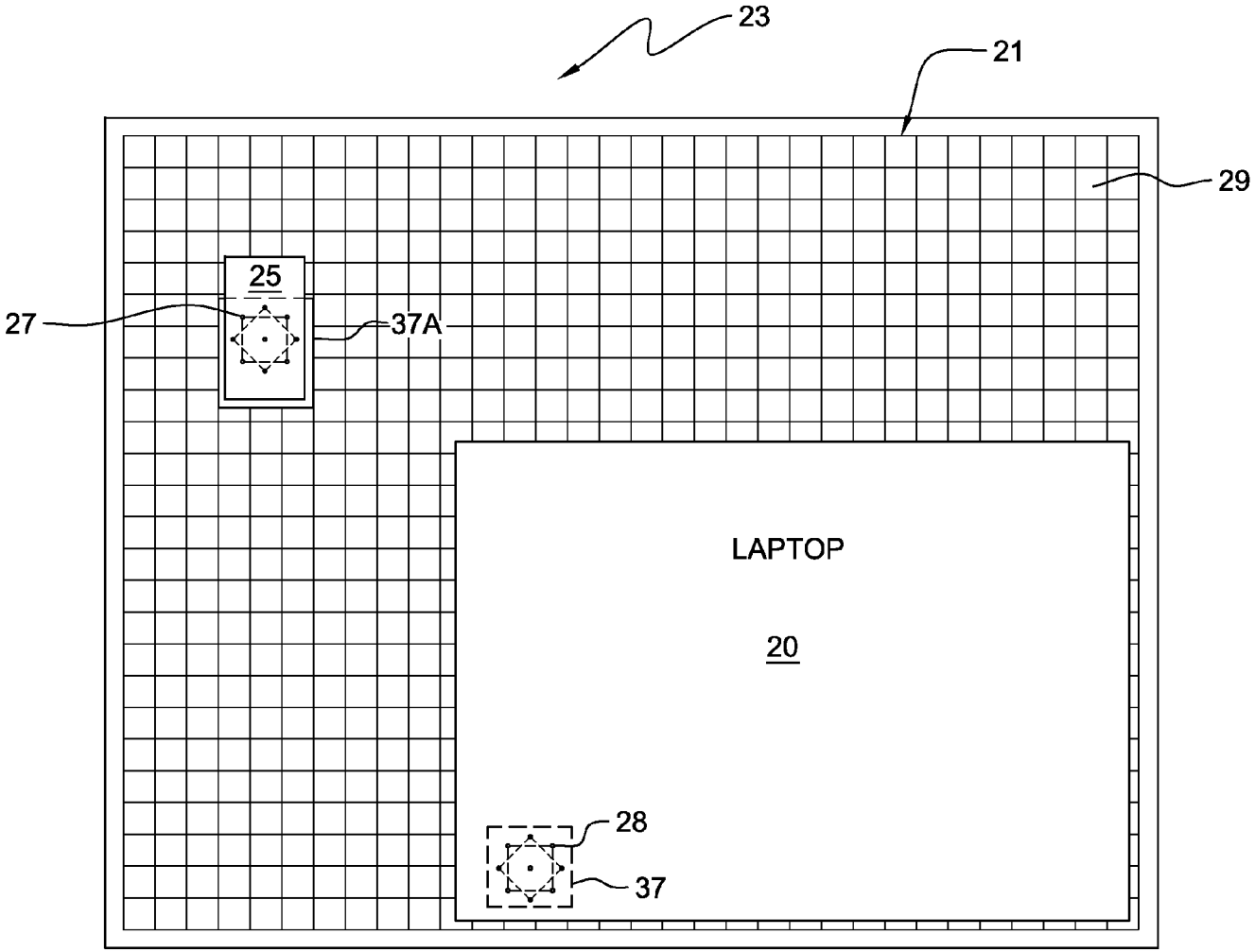
FIG. 2 is a second embodiment of a computer system using the apparatus and methods herein described.

FIG. 2 illustrates a second embodiment wherein a laptop computer 20, configured with suitable contact pins 28, as noted above, and as described below, is placed on a contact pad 21 of an apparatus 23. Apparatus 23, also in a manner similar to a USB hub, serves to connect a USB device 25, having contact pins 27 on its lower surface, with computer 20, by making electrical contact with contacts 29 of contact pad 21. A clip-on connection module 37A, as described above, may be used to support pins 28, and have electrical connection circuitry therein.

Figure 3:
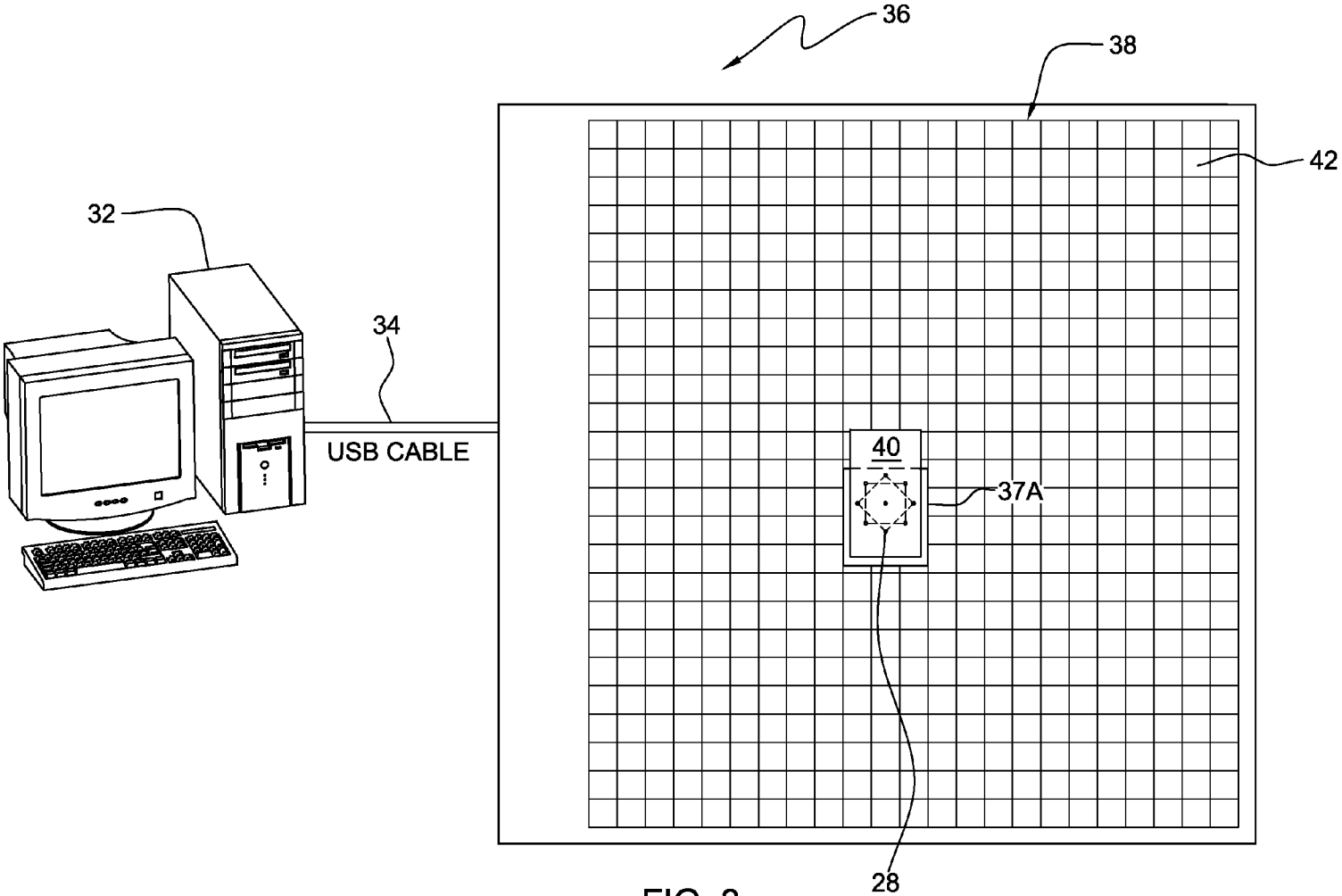
FIG. 3 is a third embodiment of a computer system using the apparatus and methods herein described.

FIG. 3 illustrates a third embodiment wherein a desktop computer 32 is connected by a USB cable 34 to an apparatus 36 having a contact pad 38 on which a USB device 40 may be placed. Apparatus 36 may be configured in part in a manner similar to a USB hub. Device 40, having pins 28 on its lower surface, communicates with computer 32 when pins 28 touch contacts 42 of contact pad 30. Computer 32 may have the same general system arrangement described above with respect to computer 20, except that it can be a desk-top computer.

In all three embodiments disclosed above, the four connections associated with the USB standard for inter-device communication, power, ground D+ and D− must be completed for communication to take place. Various methods and configurations for coupling power (essentially two connections) are discussed in the abovementioned U.S. Pat. No. 7,172,196 and United States Patent Publication Nos. 2007/0194526, 2009/0072782 and 2009/0098750. An arrangement of a so called "four pin star configuration", as well as circuitry for allowing a device having this configuration to be randomly dropped on a stripped power connection pad, are disclosed in United States Patent Publication No. 2007/0194526. United States Patent Publication No. 2009/0072782 teaches that signals may be placed on top of the D.C. power, and then separated for processing. However, there is no teaching of how to make a connection for the four different connections needed for USB communication, or for other industry standards.

Figure 5:
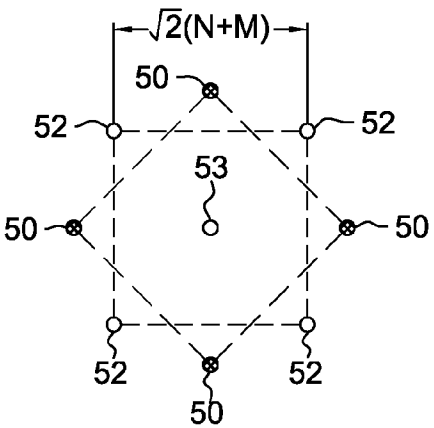
FIG. 5 is a bottom view of an arrangement of contact pins for use in making electrical connections to the contact pad of FIG. 4.
Figure 4:
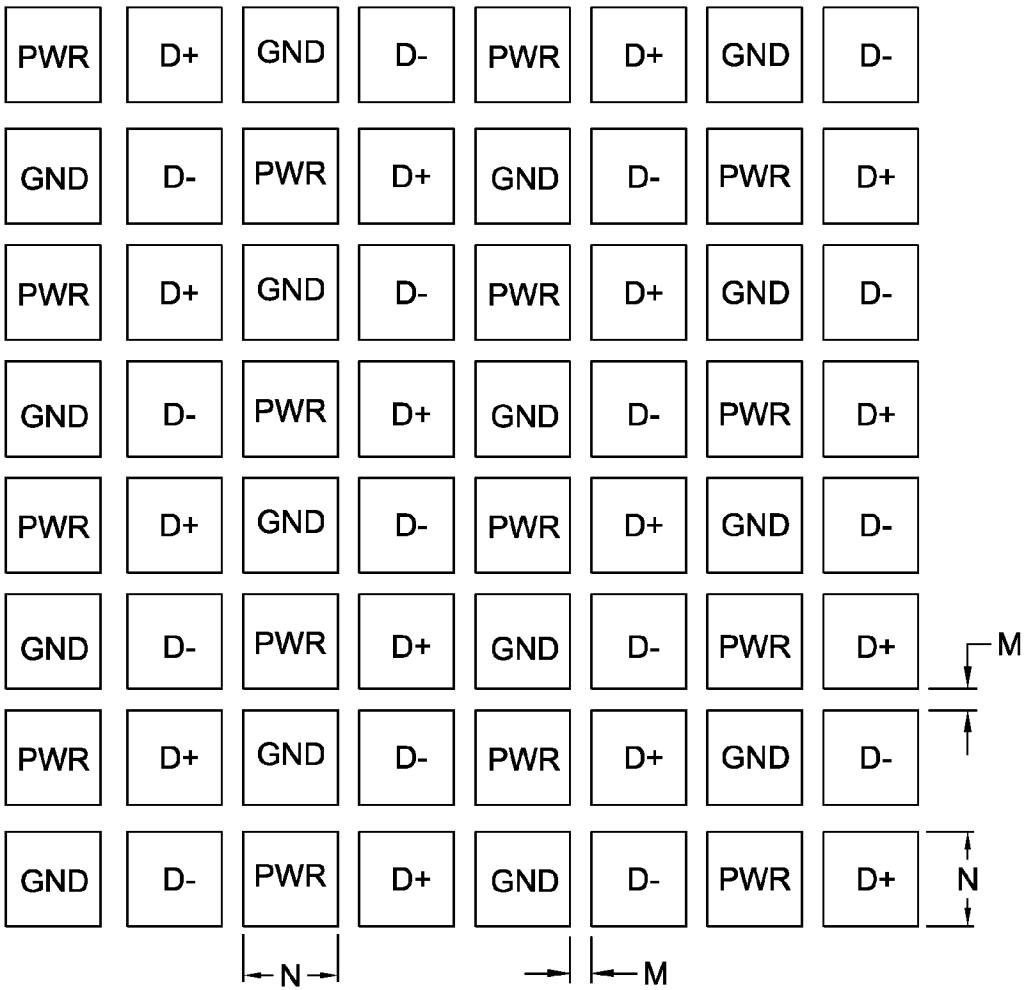
FIG. 4 is a plan view of a contact pad in accordance with one embodiment.

FIG. 4 illustrates one possible configuration for a contact pad in accordance one embodiment, while FIG. 5 illustrates a double square configuration that may be placed randomly upon the contact pad of FIG. 4, and yet assure communication of all four signals required for communication in accordance with the USB standard.

FIG. 4 illustrates a basic contact configuration of the contact pad of FIGS. 1, 2 and 3 for the four connections required for USB communication. In the vertical direction, the contacts alternate between a row of contact connected to ground (GND) and power (PWR), and an immediately adjacent row alternating between signal connections D− and D+. In the horizontal direction, the contacts alternate between a row of contacts connected to GND, D−, GND, D+, and a row of contacts connected to PWR, D+, PWR, D−. In this embodiment, all contacts are square of dimension n×n, and all common contacts are electrically connected together below the surface of the contact pad. Specifically, all PWR contacts are connected together (but not to other contacts), all GND contact are connected together (but not to other contacts), all D− are connected together (but not to other contacts) and all D+contacts are connected together (but not to other contacts). While an 8×8 array of contacts is shown, it will be understood that this may be but a partial representation of a much larger array.

FIG. 5 illustrates an arrangement for pins to be used on the bottom of the computer 20 of FIG. 1, or the bottom a USB device of FIG. 2 or FIG. 3, which is to placed on a respective contact pad. There are four pins 50 which define the corners of a first "square" A and four pins 52 which define the corners of a second "square" B, with one square being rotated substantially 45 degrees with respect to the other square, and a center pin 53, located at the center of the array of pins, thus forming a nine pin "star". The squares have a common center at the location of pin 53.

By substantially 45 degrees, it is meant that manufacturing tolerances may lead to situations wherein the angle of rotation of one square with respect to the other is not exactly 45 degrees. Such departures are within the scope of the invention, and will not prevent the apparatus from operating successfully in the majority of cases. However, if the departure from 45 degrees is large, it the probability of establishing electrical contact when the device is placed on the contact pad will be reduced from essentially one hundred percent, to some lower value.

The distance between corners on each of the overlapping squares of FIG. 5 is (N+M) times the square root of the number 2, where n is the length of a side of one square, and m is the distance between squares. For example in FIG. 4 "PWR", "GND", "D+", and "D-" are all in n by n squares. The separating line between the squares is "m" thick.

In the case of providing power to various devices, an approach using a power pad having a series of conductive pads and an arrangement of contacts on a device to receive power from those pads has been developed. There are metal stripes that alternate power and ground connection. Four metal contacts are on the device that should, no matter how the device is placed on the metal strips, create a connection between power and ground, and thus transfer power to the device to, for example, charge an internal battery. This technology, commonly know as WILDCHARGE™ is exemplified by U.S. Pat. No. 7,172,196 and United States Patent Publication Nos. 2007/0194526, 2009/0072782 and 2009/0098750. The entire contents of these patent documents are incorporated herein by reference, for all purposes.

While not on point for most embodiments, typical dimensional relations for other geometries for "stars" are described in detail in the above referenced United States Patent Publication No. 2007/0194526 and will not be repeated herein. However, it is noted that there are specific teachings therein concerning preferred dimensional relationships so that contacts are properly made for a device to receive power, regardless of the placement of pins on a power contact pad. Further, it is noted therein that the diameter of the pins should be generally smaller than the spaces between contacts, so that the pins do not serve to "short out" different types of contacts GRD, PWR, D− and D+.

In one implementation, it is necessary to have software and/or hardware to properly connect the pins 50, 52 and 53 to circuitry for interfacing with GRD, PWR, D+ and D−, in order for communication using the USB standard to take place. For example, depending on the manner in which the configuration of pins in FIG. 5 makes an electrical connection to the contacts of a contact pad (based on the exact position and orientation of computer 20 of FIG. 1, or the USB devices of FIG. 2 or 3 on a respective contact pad), some of the pins will establish connections for GRD and PWR, and others will establish connections for D- and D+.

Figure 6:
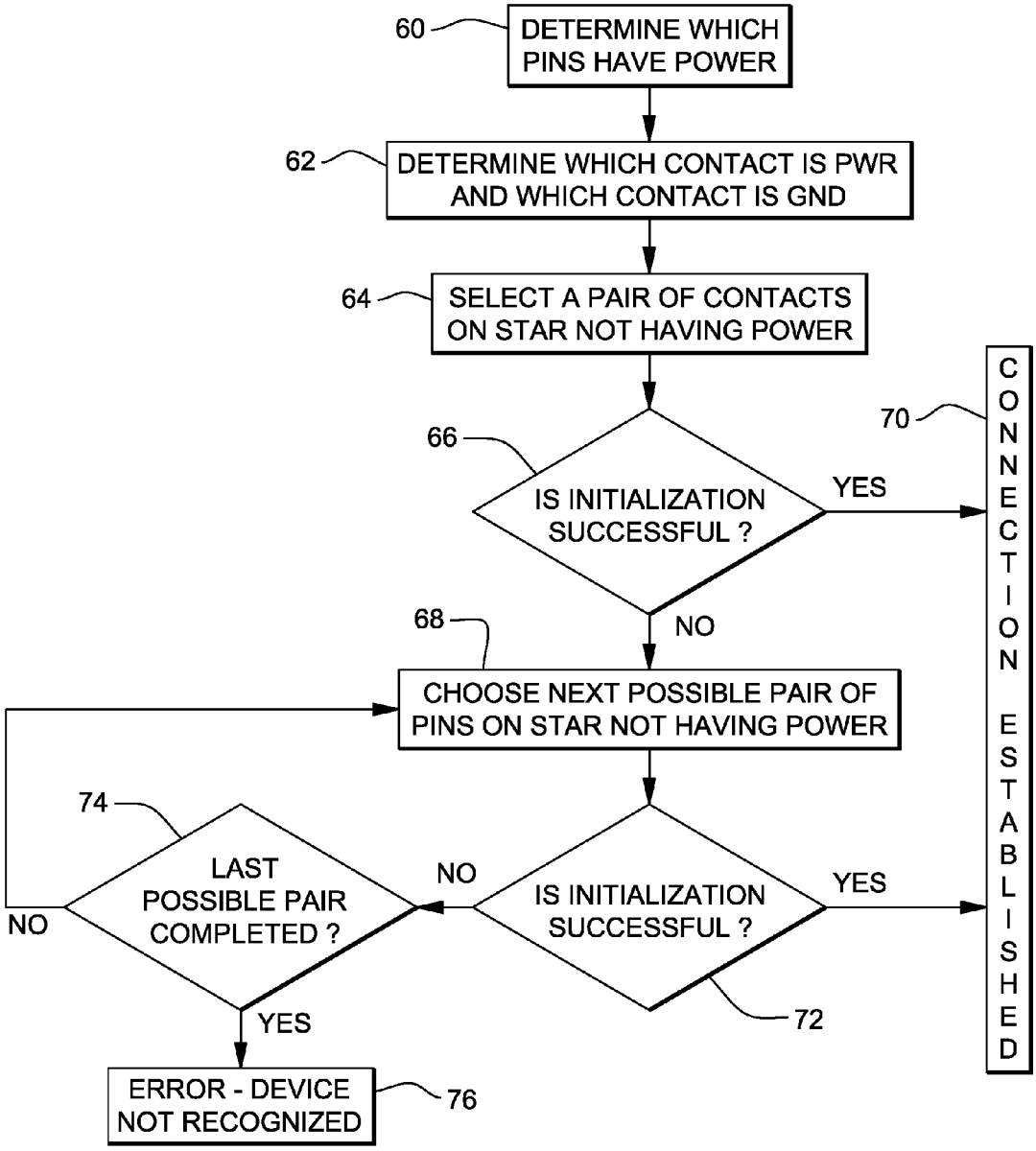
FIG. 6 is a flow chart of a first method for determining the proper connections between the contacts of the pad of FIG. 2 and the system to which a USB device placed on the contact pad of FIG. 2 is to be connected.

FIG. 6 is a flow chart of one manner of assuring that the proper connections are made. At step 60, the pins 50, 52 and 53 are checked, to determine which pins have come into contact with GND and PWR. This can be done by using a circuit to measure resistance between the pins, as there is generally a resistance of several thousand ohms between power and ground. It may also be done by using an array of diodes or a field programmable gate array (FPGA) to determine which star has pins which have come into contact with GND and PWR. A block diagram of just one possible hardware configuration is described below with reference to FIG. 7.

At step 62, a determination is made as to which of a pair of pins having the appropriate electrical resistance between them, is connected to GND, and which is connected to PWR (a polarity determination). However, alternatively, appropriate connections can be made by an arrangement of diodes, as for example that described in the above referenced United States Patent Publication No. 2007/0194526, with suitable modifications, as necessary.

At step 64 the pins not connected to GND or PWR are accessed to determine which pin is connected to D− and which to D+. At step 66, an attempt is made to initialize USB communication, for example, by the computer 20 of FIG. 1. If the correct pair has been selected (YES outcome at step 66), then communication has been established at 70. If the attempt to initialize communication times out, then the outcome is NO at step 66. A next pair of pins is accessed at step 68, and a further attempt at initialization is made at step 72. If initialization is successful, then a connection has been established as represented at step 70. If the attempt at initialization fails, and the outcome at step 72 is NO, a check is made at step 74 as to whether the last pair of pins have been chosen. If the outcome is NO, then yet another pair of pins is chosen at step 68, and flow continues to step 72. If the outcome at step 74 is YES then flow is to step 76, where an error is indicated, as no connection has been made. Appropriate inquiry and troubleshooting as to the cause of the failure to connect can be conducted.

Figure 7:
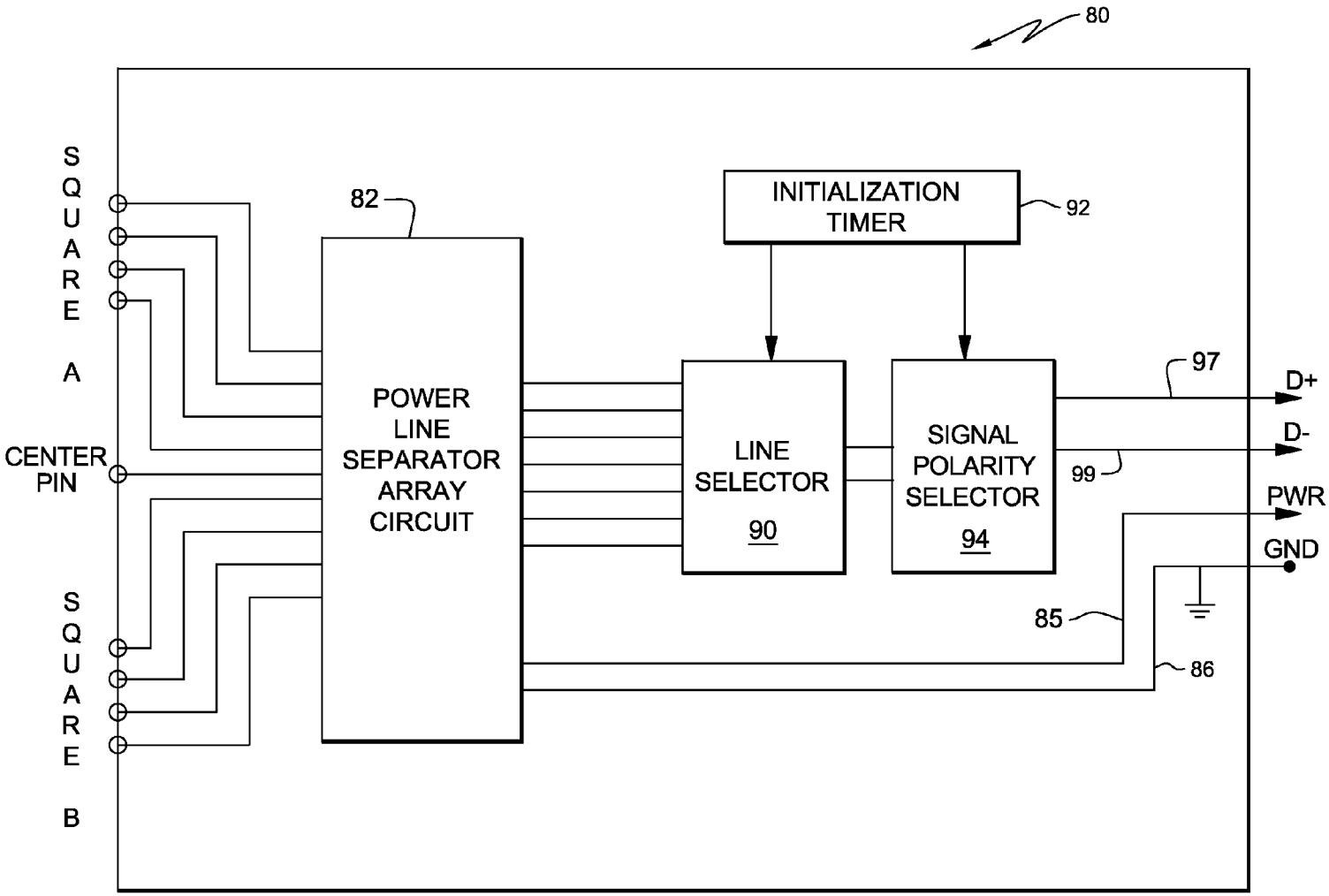
FIG. 7 is block diagram of a hardware arrangement for making appropriate connections in accordance with the apparatus and methods herein described.

FIG. 7 is a block diagram of a circuit 80 for accomplishing generally, in a hardware arrangement, the connection steps of the flow chart of FIG. 6. The four pins 50 of square A and the four pins 52 of square B, as well as center pin 53, are connected, respectively to a power line separator array circuit 82. Array circuit 82 connects the pins contacting a PWR contact and a GRD contact on a contact pad to lines 85 and 86, respectively.

The remaining seven lines which do not extend to pins connected to PWR or GND are connected to a line selector which connects two of the seven outputs of array circuit 82 to a signal polarity selector 94, which can maintain or reverse the polarity of its input lines when connecting those lines to its outputs. An initialization timer 92 provides a signal to line selector 90 to select an initial pair of lines. Initialization timer 92 also provides a signal to polarity selector 94 to select an initial polarity of the line selected by line selector 90. Initialization of USB communication is attempted with the first selected pair of lines and the first selected polarity. If initialization timer 92 times out without USB communication being established, initialization timer 92 reverses polarity, and a further attempt is made to establish USB communication. If initialization timer 92 again times out without USB communication being established, a different pair out of the seven lines is selected, and the process is repeated, including any necessary polarity reversal, until USB communication is established, or until it is determined that no connection is possible, as described above with respect to FIG. 6.

The amount of time to sequence through the possibilities and to establish USB communication will not normally be objectionable. However, it will be recognized that the approach outlined above in FIG. 6 and FIG. 7 is essentially a "brute force" technique in terms of making a USB connection. There are forty two possible combinations to try to find the proper connections for D+ and D−, as derived from C(7, 2)=21, and multiplying by two to take polarity into account. Depending upon the exact geometry used, and given a determination as to which contact is on power and which contact is on ground, there may be only a certain number of configurations where the remaining pins may land, in view of the fact that the geometric arrangement of the pins is fixed and the geometric arrangement of the contact pads is fixed. Therefore, it is possible to do an exhaustive study to determine what orientations of the shape on the pad are possible, and to then intelligently guess which contacts are on D+ and D−, leaving less than a brute force approach number of configurations to try.

A circuit of the type described above with respect to FIG. 7 may be used in an interface between pins 28 associated with computer 20 in FIG. 1, and as an interface in association with the pins of USB device 25 of FIG. 2 or the pins of USB device 40 of FIG. 3. This circuit may be build into computer 20, or associated with a USB connector plugged into a USB port on the side of computer 20.

The term "circuit" or "circuitry" is used in the summary, description, and/or claims. As is well known in the art, the term "circuitry" includes all levels of available integration, e.g., from discrete logic circuits to the highest level of circuit integration such as VLSI, and includes programmable logic components programmed to perform the functions of an embodiment as well as general-purpose or special-purpose processors programmed with instructions to perform those functions.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An arrangement for making electrical connections, comprising electrically conductive contacts arranged at corners of a first square and corners of a second square, said first square being rotated by substantially forty five degrees with respect to said second square, said squares having a common center, and an electrically conductive contact disposed at said common center.

2. The arrangement of claim 1, wherein said electrically conductive contacts are electrically conductive pins.

3. An arrangement of claim 1, in combination with an electrical connection pad having an array of four types of electrically conductive contacts, all conductive contacts of a given type being electrically connected to all other conductive contacts of the same type; said electrically conductive contacts of said pad being sized, shaped and positioned to make electrical contact with selected one of said electrically conductive contacts of said arrangement.

4. The combination of claim 3, wherein said arrangement is disposed on an outside surface of a portable electronic device so that said conductive pins contact said conductive contacts of said electrical connection pad to establish electrical connections to said portable device when said portion of said outside surface of said portable electronic device is placed on said pad.

5. The combination of claim 3, further comprising circuitry configured to operate with said electrical connection pad so that said electrical connection pad has characteristics of a universal serial bus hub.

6. The combination of claim 5, wherein said electrical connection pad includes at least one universal serial bus connection port to which a universal serial bus device is connected for electrical connections to be made with said universal serial bus device.

7. The combination of claim 6, further comprising circuitry for determining which of said electrical contacts of said arrangement is in contact with conductive contacts for electrical power, and which of said electrical contacts of said arrangement is in contact with conductive contacts for signal.

8. The combination of claim 3, wherein said electrical connection pad further comprises at least one universal serial bus cable port for connection to a universal serial bus port of a computer.

9. The combination of claim 3, wherein said types of electrically conductive contacts comprise two contacts for power and two separate contacts for signals.

10. The combination of claim 9, wherein said arrangement is configured to be disposed on an underside surface of a portable computer, and used to provide temporary electrical connections to said portable computer, further comprising a second said arrangement for a second portable device, said electrical connection pad providing electrical connections between said portable computer and said second arrangement.

11. The arrangement of claim 1, configured to provide electrical connections for apparatus utilizing a standard selected from the group consisting of four pin IEEE 1394, telephone, USB, and Ethernet® RJ45 signal connections.

12. The arrangement of claim 1, wherein said arrangement is disposed on an underside surface of a portable computer, and used to provide temporary electrical connections to said portable computer.

13. The arrangement of claim 1, wherein two of said electrically conductive contacts are for power and two of said electrically conductive contacts are for signals.

14. The arrangement of claim 13, associated with circuitry for determining which of said electrically conductive contacts of said arrangement is in contact with electrical power, and which of said electrically conductive contacts of said arrangement is in contact with signals.

15. The arrangement of claim 1, further comprising at least one additional said arrangement, each said arrangement being for connection with an electronic device, said arrangements being used to facilitate contact between said electronic devices.

* * * * *